United States Patent [19]

Kuhn

[11] 4,028,918

[45] June 14, 1977

[54] ASSEMBLY FOR APPLYING LUBRICANT TO THE WORKING AREA OF A PUNCHING DEVICE

[75] Inventor: Hans Kuhn, Hofstetten, Switzerland

[73] Assignee: Hatebur Umformmaschinen AG, Basel, Switzerland

[22] Filed: Jan. 14, 1976

[21] Appl. No.: 649,084

[52] U.S. Cl. ..... 72/45; 10/106

[51] Int. Cl.[2] ..... B21J 3/00

[58] Field of Search ..... 10/7, 26, 76 R, 86 F, 10/106; 72/41–45

[56] References Cited

UNITED STATES PATENTS

| | | | |
|---|---|---|---|
| 730,045 | 6/1903 | Porterfield | 10/106 X |
| 1,471,669 | 10/1923 | Miller | 72/45 |
| 2,161,265 | 6/1939 | Stahlhammer | 10/106 X |
| 2,302,857 | 11/1942 | Harder | 72/44 |
| 2,352,429 | 6/1944 | Gomperz | 10/7 |
| 3,427,840 | 2/1969 | Richter | 72/44 |
| 3,561,238 | 2/1971 | Tetzloff et al. | 72/45 X |
| 3,877,271 | 4/1975 | Maddock | 72/45 X |
| 3,906,566 | 9/1975 | Rose | 10/26 X |

*Primary Examiner*—E. M. Combs
*Attorney, Agent, or Firm*—Lowe, King, Price & Markva

[57] ABSTRACT

Device for applying lubricant to the workpiece and/or working surface of the punch of a multistage forging press. Channels are provided between the stepped holding pin of the punch and the wall of the stepped bore in which the holding pin reciprocates. The channels are connected via the interior of the punch to an external lubricant reservoir. The space formed with each stroke of the punch between the shoulders of the holding pin and its stepped bore acts as a pumping space. Each punch stroke causes lubricant to be drawn from the reservoir into the pumping space and subsequently forced out through the channels. Means are also provided by which the supply of lubricant from the reservoir can be more closely regulated in time with the working stroke of the press.

14 Claims, 10 Drawing Figures

ASSEMBLY FOR APPLYING LUBRICANT TO THE WORKING AREA OF A PUNCHING DEVICE

BACKGROUND OF THE INVENTION

The invention concerns a means for applying lubricant to the workpiece and/or the working surface of the punch of a multi-sage forging press for the non-cutting forming of metal workpieces having a die, a reciprocatingly driven punch located coaxial to and opposite the die and a holding pin movably mounted in a central bore of the punch.

It is well known to those skilled in the art that wear and deformation of the punch of a forming press can occur in the non-cutting forming of metal workpieces. When the forming operation is intense giving a thin-walled pressing, these undesirable phenomena can appear after only a low number of workpieces has been machined. They lead to a considerable lowering of the surface quality of the workpieces, which must subsequently go through an expensive further machining operation.

The use of a lubricating liquid or an appropriate powder is already the practice on drop foring presses. On this type of press the lubricant, for instance a graphitiferous lubricating liquid, is sprayed onto the workpiece shortly before the puunch descends and acts as a separating agent when the punch and workpieces are in contact, ensuring that they detach easily from each other. This protects the contact surfaces of the punch and the workpiece. This method cannot however be applied to automatically operated multi-stage presses which work at a high stroke rate. This limitation is the result of two features of this sort of press. Firstly the rapid periodic motion of the tools would not allow an additional spraying means to be installed, and secondly the lubricant would be carried away by the cooling water, which is sprayed onto the workpiece from all directions, thus not allowing any lubricant to reach the workpiece.

It is therefore the aim of this invention to suggest a means enabling workpieces to be intensively lubricated even on multi-stage forging presses. This is achieved by ensuring in particular that the lubricant is not swept away by cooling water the moment it is applied, but reaches the crucial place, i.e. between the workpiece and the working surface of the punch.

SUMMARY OF THE INVENTION

The invention achieves this object by arranging that there is at least one channel between the periphery of the holding pin and the adjacent wall of the bore. This mouth of this channel lies in the plane of the working surface of the punch and is connected via the interior of the punch to a lubricant reservoir. The invention also includes means for forcing the lubricant under pressure in a continuous stream or a series of pulses through the interior of the punch and through said channel(s) as well as for discharging the lubricant in the region of the working surface of the punch.

It can also be expedient for the holding pin to be located in a stepped bore in the punch and to have a circular shoulder which makes contact with a correspondingly shaped circular shoulder in the wall of said stepped bore. The front section of the holding pin has several truncations or flat sections which extend from the circular shoulder to the end of the holding pin and are parallel to the axis of the holding pin. The rear section of the holding pin is provided with a supply bore which links the lubricant reservoir with said annular shoulder of the holding pin in such a way that the lubricant flows into the annular space created between the inclined shoulder of the holding pin and the inclined shoulder of the stepped bore in the punch when the holding pin is pushed into the punch. When the holding pin moves out again said annular space is made smaller and lubricant is discharged through the channels between said flat sections and the wall of the front section of said stepped bore.

Thus, a punch means includes a working surface, a holding pin and a punch member having a central bore. The holding pin is disposed to move within the central bore. The holding pin is disposed to move within the central bore between an extended holding position and a retracted position in a direction parallel to the reciprocating movement of the punch means. The central bore has a lubricant discharge portion at the outer end of the punch member and a lubricant pumping portion adjacent the lubricant discharge portion. The front section of the holding pin is movably operated in lubricant discharge bore portion. The rear section of the holding pin movably operates in the lubricant pumping bore portion. Channel means extend along the lubricant discharge bore portion. Supply of lubricant is provided under pressure to the central bore and biasing means are effective to maintain no relative movement between the holding pin and the punch member during the working stroke of the punch means until the front section of the holding pin engages a workpiece. Punch member is movable forwardly with respect to the holding pin with the relative movement therebetween causing lubricant to flow into the lubricant pumping bore portion ahead of the rear section of the holding pin. The biasing means is further effective to move the rear section of the holding pin forwardly with respect to the punch member during the return stroke of the punch means. Thus, lubricant is caused to flow from the lubricant pumping bore portion through the channel means into the working area.

BRIEF DESCRIPTION OF THE DRAWINGS

An illustratory embodiment of the subject of the invention as well as several constructional variants are illustrted in the accompanying drawings.

DESCRIPTION OF SPECIFIC EMBODIMENTS

Figure 1:
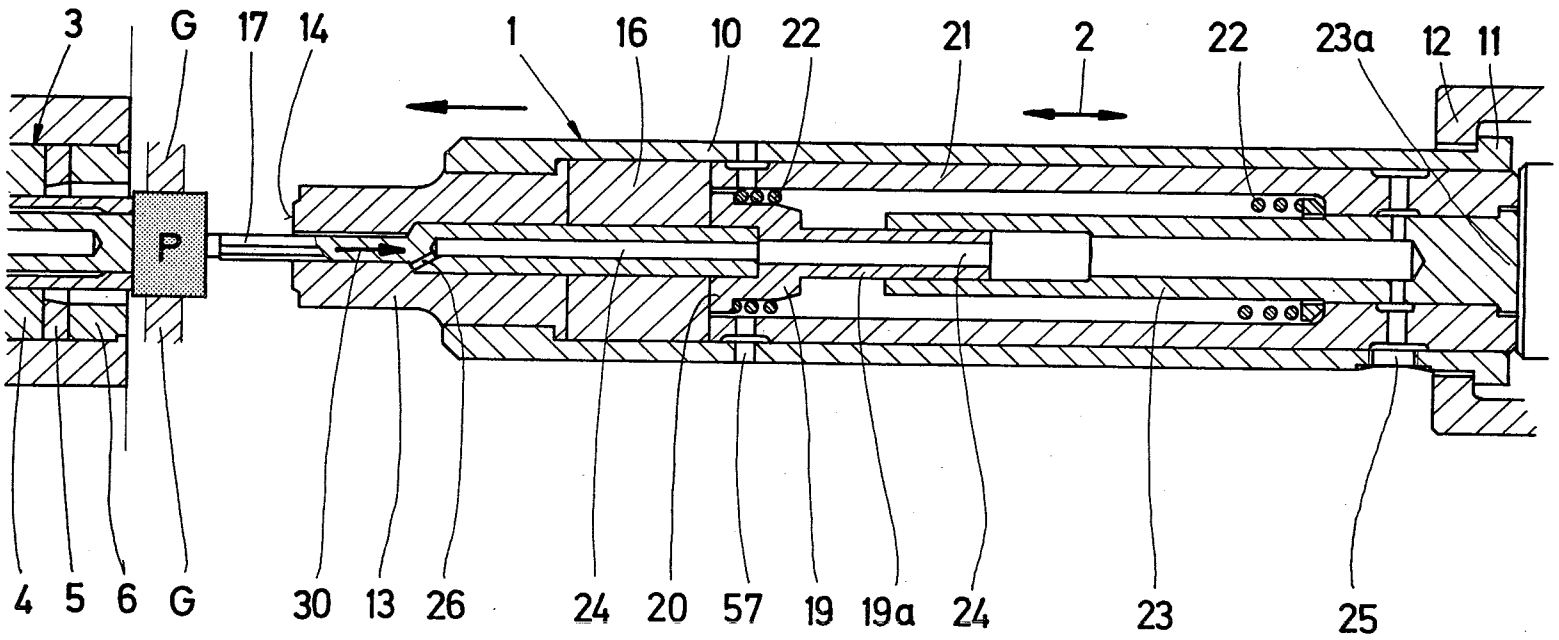
FIG. 1 is a simplified representation of the forming tools of a forming station on an automatically operated multi-stage forging press and shows the punch shortly before the latter strikes the workpiece.
Figure 2:
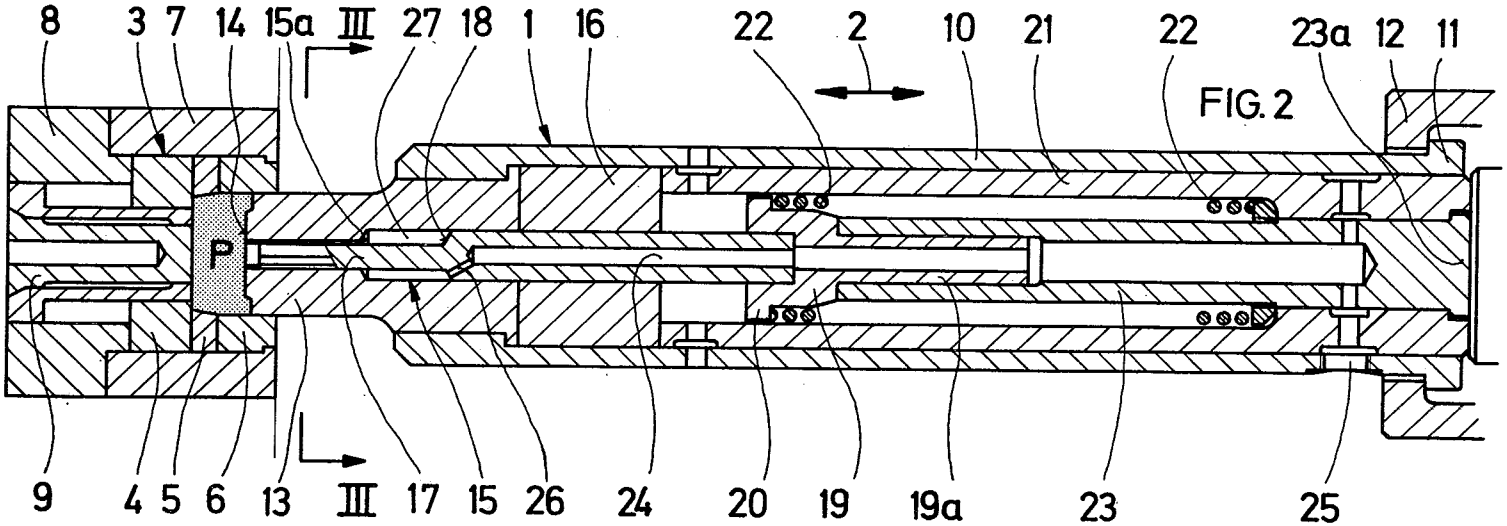
FIG. 2 shows the same tool arrangement on completion of the forming operation.

FIGS. 1 and 2 show a punch, denoted as a whole by 1, which reciprocates in the direction of the double-headed arrow 2 and works together with a multiple-part die 3. The die 3 is made up of three rings 4, 5 and 6, but its detailed construction is of subsidiary importance to the present invention. The die parts 4 to 6 are held together by a holding ring 7 and an anvil 8. In addition an axially movable ejector 9 is associated with the die.

The punch 1 has a cylindrical casing 10 which is guided by a tool support (not illustrated). The annular shoulder 11 of this casing is connected to the press sled via and end collar 12.

A punch-head 13 is mounted in the front section of the casing 10. The working surface 14 of the punch-head has the same profile as the workpiece P.

The punch-head 13 is designed with a stepped bore 15 having an inclined shoulder 15*a* (FIG. 2) and extending through an intermediate piece 16. The holding pin 17 is located in the bore 15 so that it can move axially. The holding pin 17 also has an inclined shoulder 18 (FIG. 2) and the rear end of the holding pin 17 is rigidly connected to an adapter 19. The adapter 19 has an annular flange 20 which not only guides the adapter along the inside wall of a sleeve 21, but also acts as the spring rest for a helical spring 22. A tubular extension 19*a* to the adapter 19 projects into a guide bushing 23 which is anchored by means of an annular flange 23*a* at the rear end of the sleeve 21.

The mutually coaxial bores in the holding pin 17, the adapter 19 and its extension 19*a* and in the guide bushing 23 thus form a lubricant supply channel 24 which can be joined up via a radial bore 25 to a supply line (not illustrated).

The end of the channel 24 within the holding pin 17 is connected to a pumping space 27 by an inclined bore 26 which opens out into the pumping space 27 in the regions of the inclined shoulder 18 (FIG. 2).

Figure 3:
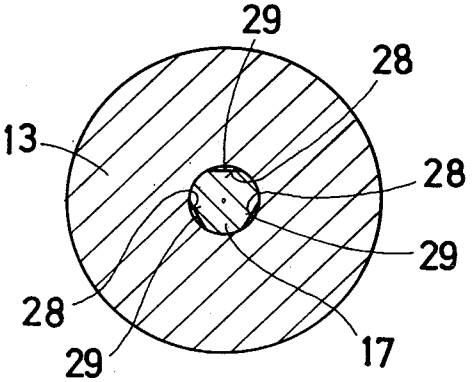
FIG. 3 is a section along the line III—III in FIG. 2.

As FIG. 3 shows, the front section of the holding pin 17 has three flat sections 28 distributed at 120° to each other so that three channels 29 of segment-shaped cross-section are formed between these flat sections and the wall of the front part of the stepped bore 15. These channels thus link the pumping space 27 with the working space 14 of the punch.

When the press is in operation, the punch 1 reciprocates in the direction indicated by the double-headed arrow 2. With each stroke of the punch a work-piece P is pushed into the die, formed and subsequently transferred to the next station by the grippers G of a transverse transfer means.

As the punch 1 moves towards the die 3 at the beginning of its stroke, the holding pin 17 at first projects out of the punch-head 13 and the inclined shoulder 18 of the holding pin 17 is pressed against the matching inclined shoulder 15*a* of the stepped bore 15 by the spring 22. In this position of the punch the pumping space 27 has zero volume.

As soon as the end of the holding pin 17 makes contact with the workpiece P held ready in front of the die (FIG. 1), the holding pin 17 is brought to a halt and then moves, relative to the punch-head 13, in the direction of the arrow 30. The inclined shoulder 18 of the holding pin is lifted away from that of the stepped bore 15 and the pumping space 27 is formed which increases in size as the motion of the holding pin 17 relative to the punch-head 13 progresses. Lubricant, which is under a static pressure, is forced into the pumping space 27 from a lubricant reservoir (not illustrated) connected to bore 25.

Figure 4:
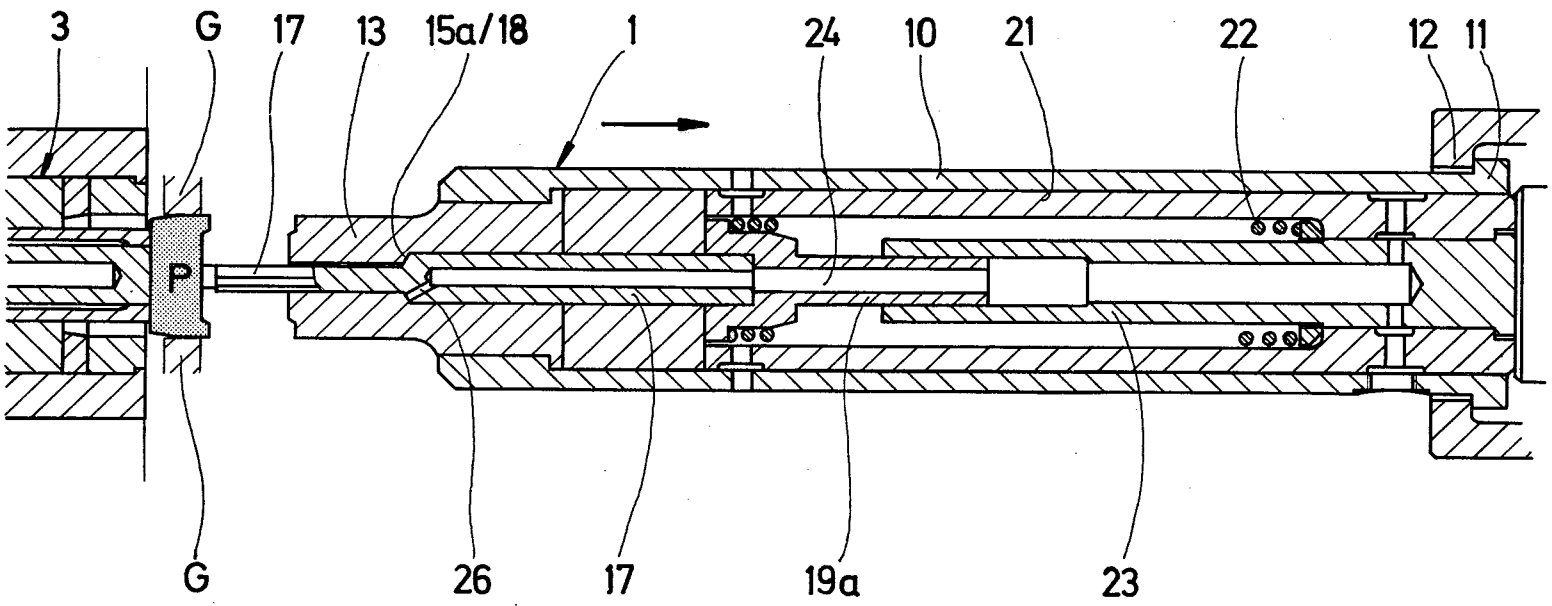
FIG. 4 shows the same tool arrangement as the punch is withdrawing and FIGS. 5 to 10 illustrate constructional details of the lubricating means.

When the holding pin 17 has been completely pushed into the punch-head and the end of the holding pin is flush with the working surface 14 of the punch-head, the pumping space 27 is at its largest volume and, of course, also filled with lubricant. During the subsequent forming operation the situation remains practically unaltered until the final position shown in FIG. 2 is reached. In this position the direction of motion of the punch 1 reverses and the punch begins to withdraw. The punch-head 13 lifts relatively rapidly away from the workpiece P, while the workpiece is ejected from the die 3 by the ejector 9 associated with the die. But as soon as the working surface 14 of the punch begins to disengage from the workpiece P, the holding pin 17 is pushed out of the punch by the spring 22 so that the workpiece P is held for a short time between the ejector 9 and the holding pin 17. This is necessary in order that the workpiece can be gripped and transferred to its next position by the transfer grippers G (FIG. 4).

As the punch 1 lifts away from the workpiece P, the mouths of the channels 29 are exposed however. At the same time as the holding pin 17 reemerges, the inclined shoulder 18 moves forward towards shoulder 15*a* and the pumping space 27 becomes smaller. By virtue of the static pressure mentioned above, the lubricant contained in the pumping space 27 cannot escape towards the rear but is discharged through the channels 29. Thus the lubricant reaches the workpiece itself, prelubricating it for the next forming operation. Some of this lubricant also adherres to the working surface 14 of the punch, thus prelubricating the punch for the next stroke.

The bulk of the lubricant is certainly discharged at the beginning of the return stroke of the punch, discharge of lubricant in fact lasting as long as the relative motion between holding pin 17 and punch-head 13 lasts — i.e. as long as the pumping action of the inclined shoulder 18 of the holding pin 17 lasts. The lubricant pressure can however be balanced against the biasing force of the spring 22 so that a certain amount of lubricant even emerges during the forward stroke of the punch.

The means described above thus ensures that there is a layer of lubricant between the punch 1 and the workpiece P when the two make contact. The manner and time of application of the lubricant also ensures that the lubricant is not carried away by the cooling water spraying in all directions. It should in particular be pointed out that the lubricant is not sprayed out but discharged in a compact jet or a gentle stream (depending on the pressure in the pumping space 27) and therefore remains on the working surface 14 of the punch and/or on the workpiece P.

The means described could for instance be improved by including a device for regulating the amounts of lubricant applied with each stroke of the punch.

This can be achieved quite simply by using outlet channels 29 of various cross-sections as required. A number of holding pins 17 with flat sections 28 of different areas would be kept in stock for this purpose.

A similar effect can be achieved by varying the static pressure on the lubricant reservoir.

The quantity of lubricant discharged can also be influenced by altering the viscosity of the lubricant, i.e. by adding an appropriate amount of petroleum.

It seems to be of particular practical advantage however if the lubricant reservoir is acted on by pulses of compressed air regulated by a valve which works in time with the press. The system can for instance be set up so that the pressure impulse on the lubricant is given as soon as the holding pin 17 makes contact with the workpiece during the forward stroke of the punch. In this case too, careful pressure alteration allows more clearly graduated regulation of the lubricant doses. But it is more important with this variant to ensure that the lubricant is in fact discharged at the desired instant and is not under pressure during the rest of the punch stroke.

Figure 5:
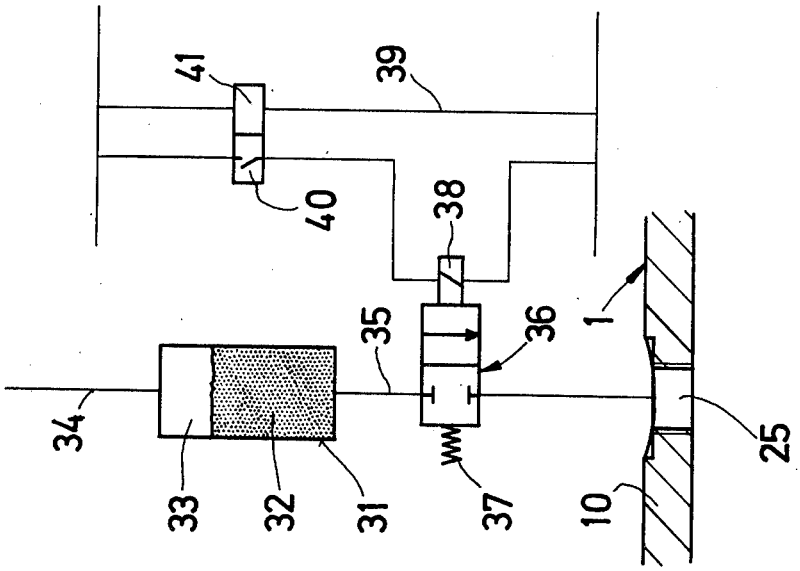

A variant of the pressure-pulse arrangement is schematically shown in FIG. 5. The lubricant 32 in the container 31 is continuously held at a minimum pressure by a compressed air buffer 33. A compressed air line 34 links the container 31 with a compressor.

A link-line 34 connects the container 31 to the bore 25 in the punch 1. A two-way acting solenoid valve 36 is situated in this link-line 35. The shut-off member of this solenoid valve 36 is closed by a spring 37 in a way familiar to one skilled in the art and can be opened by current impulses fed to the solenoid 38. A switch 40 in the solenoid circuit 39 is periodically actuated in time with the stroke of the press. This results in the valve 36 opening in time with the press and the lubricant supply being released at the desired instant.

Figure 7:
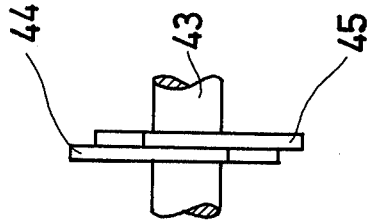
Figure 6:
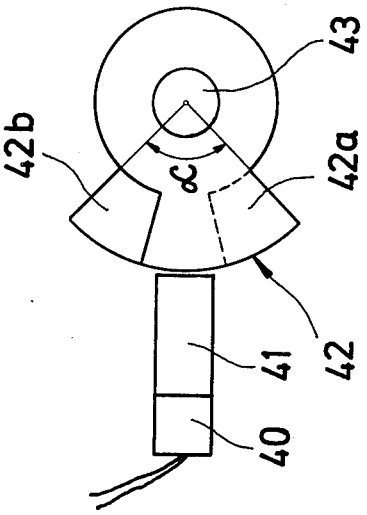

FIG. 6 shows the dependence of the actuation of the switch 40 on the rate of working of the press. The switch 40 is coupled to a proximity initiator 41, located within the sphere of influence of the rotating metal vane 42. The vane 42 is non-rotatably mounted on a shaft 43, which is coupled to the main shaft of the press in a way which is not illustrated. In the embodiment chosen as the example two metal discs 44, 45 are used as the vane carrier (FIG. 7). These discs have sector-like extensions which form the two partially superimposed halves 42*a*/42*b* of the vane. The two discs 44/45 can be rotated with respect to each other on the shaft 43 so that the vane angle $\alpha$, and hence the timing of the solenoid valve 40, can be adjusted according to requirements.

The mode of action of the proximity initiator is known to those skilled in the art. As soon as the vane comes round to the proximity initiator an electrical field in the proximity initiator 41 is influenced in such a way that the proximity initiator actuates the built-in switch 40. This closes the solenoid valve circuit; the solenoid valve comes into operation and releases the pressurized lubricant. As the vane moves away from the proximity initiator, the switch 40 breaks the circuit, the voltage through the solenoid valve 36 falls off and the solenoid valve is brought back by the spring 37 to its closed starting position.

The container 31 may also be provided with a device for automatically replenishing the lubricant.

Figure 9:
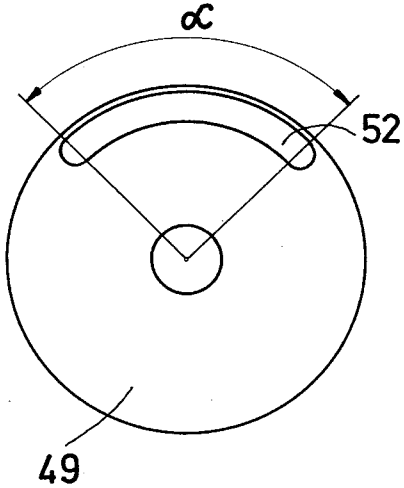
Figure 8:
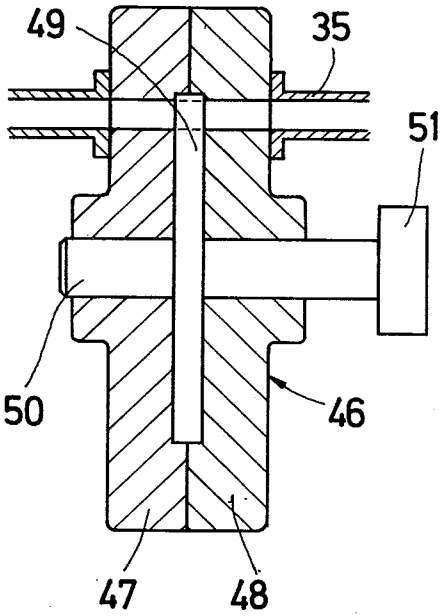

FIGS. 8 and 9 show schematically a further variant of the pressure-pulse lubricant dose arrangement. Here too, the lubricant is kept under a static pressure in a container (not shown). A dosaging device 46 is built into the link-line 35 joining the container to the bore 25 in the punch 1. The dosaging device 46 has a rotating disc 49 located between two flanges 47/48. The disc 49 is rigidly connected to a shaft 50 and can be coupled via a drive member 51 to the main drive of the press. The upper part of the disc 49 projects into the link-line 35 and in this area has a curved slot 52 which is concentric with axis of the shaft 50 and extends through an angle $\alpha$.

The rotating , slotted disc 49 thus takes the place of the solenoid valve 36 of FIG. 5. Each revolution of the disc exposes the slot 52 to the lubricant in the link-line 35. The length of this exposure period is determined by the arc-length of the slot which corresponds to the angle $\alpha$. The exposure period can therefore be altered by simply replacing the disc.

The position of the slot 52 with respect to that of the punch at any instant can be varied by changing the disc. The boss of the disc 49 and the shaft 50 could for instance be provided with toothing for this purpose.

Figure 10:
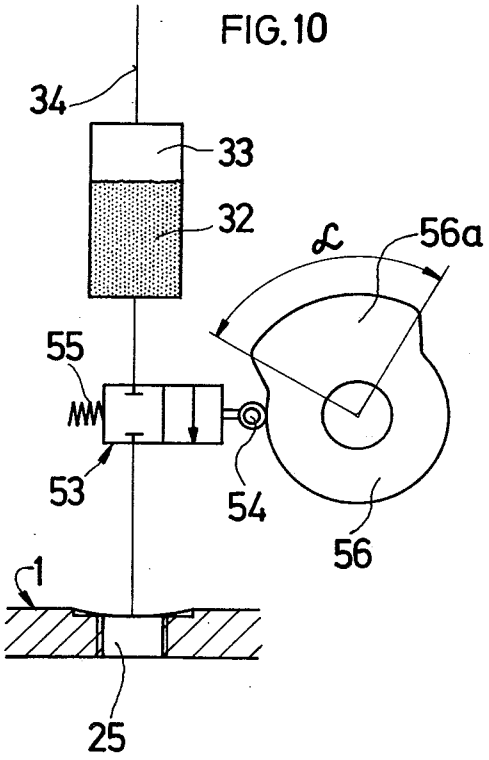

FIG. 10 shows a roller valve 53 instead of the solenoid valve 36 considered in conjunction with FIG. 5. The shut-off member of the roller valve is linked to a roller 54. The roller 54 is biased by a spring 55 and situated within a radius of action of a drive cam 56 which again rotates in time with the stroke of the press. When the dog 56*a* makes contact with the roller 54, the valve 53 is opened. After the dog 56*a* has passed by, the spring 55 brings the shut-off member of the valve back to its closed position.

What was said in connection with FIGS. 8 and 9 about the length of time the valve remains open (angle $\alpha$) and the time at which the valve opens (the position of the dog 56*a* with respect to that of the punch at any instant) also applies to the roller valve 53.

The embodiments described above should merely be viewed as examples of this invention which one skilled in the art could vary in many different ways.

The lubricant used could for instance be "Berulit 500" produced by Carl Bechem GmbH, Hagen.

The punch housing could advantageously include a drain bore 57 through which small amounts of lubricant which might arise as a result of leakages could drain away.

I claim:

1. An assembly for the noncutting forming of metal components wherein lubricant is applied to the working area of a working tool, said assembly comprising:

a. a die, b. a punch means positioned opposite and coaxial with the die and being reciprocatingly driven to move toward the die during a working stroke and away from the die during a return stroke, c. said punch means including a working surface, a holding pin means and a punch member having a central bore, d. said holding pin means being disposed to move within the central bore between an extended holding position and a retracted position in a direction parallel to the reciprocating movement of the punch means, e. said central bore having a lubricant discharged portion at an outer end of the punch member and a lubricant pumping portion adjacent the lubricant discharge portion, f. said holding pin means having a front section movably operating in the lubricant discharge bore portion and a rear section movably operating in the lubricant pumping bore portion, g. channel means extending along the lubricant discharge bore portion, h. means providing a supply of lubricant under pressure to said central bore, and i. biasing means being effective to maintain no relative movement between the holding pin means and the punch member during the working stroke of the punch means until said front section engages a workpiece, j. said punch member being movable forwardly with respect to the holding pin means with the relative movement therebetween causing lubricant to flow into the lubricant pumping bore portion ahead of said rear section of the holding pin means, k. said biasing means being effective to move said rear section of the holding pin means forwardly with respect to the punch member during said return stroke of the punch means to cause lubricant to flow from the lubricant pumping bore portion through said channel means into said working area.

2. An assembly as defined in claim 1 wherein the channel means includes at least one channel located between the periphery of the front section of the holding pin in means and the wall of the lubricant discharge bore portion.

3. An assembly as defined in claim 2 wherein said at least one channel having a mouth lying in the plane of the working surface.

4. As assembly as defined in claim 1 wherein said channel means is effective to provide a continuous stream of lubricant flow under pressure.

5. An assembly as defined in claim 1 wherein said central bore has a stepped annular shoulder defining a forward end wall of the lubricant pumping portion adjacent the lubricant discharge portion, said rear section having a correspondingly shaped annular shoulder which contacts said stepped annular bore position when the holding pin means is in a fully extended position, an annular pumping chamber being defined between said annular shoulders within said lubricant pumping bore position when the said annular shoulders are out of contact with respect to each other.

6. An assembly as defined in claim 1 wherein said supply providing means comprises a lubricant reservoir being under substantially constant, static pressure.

7. An assembly as defined in claim 6 wherein said supply providing means comprises a central supply bore openly connected at one end thereof to the area ahead of the rear section of the holding pin means, said lubricant reservoir being located outside said punch means, and said supply providing means further including coupling means for interconnecting the lubricant reservoir to the other end of said central supply bore, said coupling means including a control valve means for periodically opening the flow of the lubricant from the lubricant reservoir to the punch means in time with the working stroke of the punch means.

8. An assembly as defined in claim 7 wherein the control valve is a solenoid valve which is periodically actuated by a proximity initiator which responds to a member rotating in time with the working stroke of the punch means.

9. As assembly as defined in claim 8 wherein the member which actuates the proximity initiator has two coaxial sectors which are at least partly superimposed and can be rotated both with respect to each other and with respect to their common axis.

10. An assembly as defined in claim 6 wherein the control valve is a roller valve connected to a spring-biased roller which projects outwardly from the valve casing, the roller works in conjunction with a cam disc which rotates in time with the working stroke of the punch means.

11. An assembly as defined in claim 1 wherein said supply providing means includes a lubricant reservoir, compressed air means and a supply regulating disc, said lubricant reservoir being located outside said punch means, said compressed air means being effective to maintain the lubricant reservoir under static pressure, and said supply regulating disc being rotatable in time with the working stroke of the punch means and having at least one reguating slot located in a circumferential region of the disc which periodically allows the lubricant to flow through said punch means and out of said channel means.

12. An assembly as defined in claim 1 wherein the front section of the holding pin means includes several flat sections to form longitudinal spaces along the wall of the lubricant discharge bore portion, said longitudinal spaces constituting said channel means.

13. An assembly for the noncutting forming of metal components wherein lubricant is applied to the working area of a working tool, said assembly comprising:

a. a die, b. a punch means positioned opposite and coaxial with the die and being reciprocatingly driven to move toward the die during a working stroke and away from the die during a return stroke, c. said punch means including a stepped holding pin means and a punch member having a stepped central bore, d. said stepped holding pin means being movably disposed in the stepped central bore between an end position and a retracted position, e. said stepped holding pin means having an annular shoulder which makes contact with a correspondingly shaped annular shoulder of the stepped central bore when in said end position, f. said stepped holding pin means having a front section ahead of said annular shoulder, g. channel means located between the front section of the stepped holding pin means and the wall of the stepped central bore, h. a lubricant reservoir located outside the punch means and connected to the channel means via the interior of the punch means, i. said punch member being movable forwardly with respect to the holding pin means to form a pumping space between said annular shoulder, j. said pumping space being made smaller when the punch member moves away from the die and rearwardly with respect to the holding pin means, k. each stroke of the punch means being effective to cause lubricant to be drawn from the reservoir into the pumping space and subsequently forced out through the channel means.

14. An assembly as defined in claim 13 wherein regulating means control the supply of lubricant from the lubricant reservoir in time with the working stroke of the press means.

* * * * *